US010393445B2

(12) United States Patent
Takagi et al.

(10) Patent No.: US 10,393,445 B2
(45) Date of Patent: Aug. 27, 2019

(54) EVAPORATOR

(71) Applicant: KEIHIN THERMAL TECHNOLOGY COPORATION, Oyama-shi (JP)

(72) Inventors: Motoyuki Takagi, Oyama (JP); Naohisa Higashiyama, Oyama (JP); Osamu Kamoshida, Oyama (JP)

(73) Assignee: KEIHIN THERMAL TECHNOLOGY CORPORATION, Oyama-Shi (JP)

( * ) Notice: Subject to any disclaimer, the term of this patent is extended or adjusted under 35 U.S.C. 154(b) by 0 days.

(21) Appl. No.: 15/815,706

(22) Filed: Nov. 17, 2017

(65) Prior Publication Data

US 2018/0149431 A1 May 31, 2018

(30) Foreign Application Priority Data

Nov. 28, 2016 (JP) ..... 2016-229853

(51) Int. Cl.

| | |
|---|---|
| ***F28D 1/053*** | (2006.01) |
| ***F28F 9/02*** | (2006.01) |
| ***F28F 9/00*** | (2006.01) |
| *F28D 21/00* | (2006.01) |

(52) U.S. Cl.

CPC ..... *F28D 1/05358* (2013.01); *F28D 1/05391* (2013.01); *F28F 9/001* (2013.01); *F28F 9/0204* (2013.01); *F28F 9/028* (2013.01); *F28D 2021/0085* (2013.01)

(58) Field of Classification Search

CPC ..... F28D 1/05391; F28D 2021/0085; F28F 9/0204; F28F 9/0207

USPC ..... 165/153, 174

See application file for complete search history.

(56) References Cited

U.S. PATENT DOCUMENTS

| | | | | |
|---|---|---|---|---|
| 6,272,881 | B1 * | 8/2001 | Kuroyanagi et al. | F28D 1/035 165/153 |
| 6,449,979 | B1 * | 9/2002 | Nagasawa et al. | F28D 1/0391 62/503 |
| 2005/0247443 | A1 * | 11/2005 | Kim | F28D 1/05391 165/176 |

(Continued)

FOREIGN PATENT DOCUMENTS

| | | |
|---|---|---|
| JP | 2009-156532 | 7/2009 |
| JP | 2012-197974 | 10/2012 |

*Primary Examiner* — Allen J Flanigan

(74) *Attorney, Agent, or Firm* — Mori & Ward, LLP

(57) ABSTRACT

An evaporator includes a first descending flow tube group provided between a first upper header and a first lower header, and a second descending flow tube group provided between a second upper header and a second lower header to be located windward of the first descending flow tube group. The first upper header includes a first compartment communicating with the upper end of the first descending flow tube group, and the second upper header includes a third compartment communicating with the upper end of the second descending flow tube group. A first flow distribution control section having a first refrigerant passage section for communication between the first and third compartments is disposed between these compartments. The area of a portion of the first refrigerant passage section on the upstream side is larger than the area of a portion of the first refrigerant passage section on the downstream side.

13 Claims, 10 Drawing Sheets

(56) References Cited

U.S. PATENT DOCUMENTS

| | | | | |
|---|---|---|---|---|
| 2010/0147501 | A1* | 6/2010 | Art et al. | F28D 1/05391 165/175 |
| 2011/0139413 | A1* | 6/2011 | Coyle et al. | F28D 1/05391 165/148 |
| 2011/0303401 | A1* | 12/2011 | Kamoshida et al. | B60H 1/00335 165/173 |
| 2012/0096894 | A1* | 4/2012 | Higashiyama et al. | F25B 39/02 62/525 |
| 2014/0124183 | A1* | 5/2014 | Hwang | F25B 39/00 165/173 |

* cited by examiner

EVAPORATOR

BACKGROUND OF THE INVENTION

The present invention relates to an evaporator suitable for use in a car air conditioner, which is a refrigeration cycle to be mounted on an automobile, for example.

In this specification and appended claims, the upper, lower, left-hand, and right-hand sides of FIGS. 1 to 3 will be referred to as "upper," "lower," "left," and "right," respectively, and a direction represented by arrow X in FIGS. 1 and 2 will be referred to as an "air-passage direction."

An evaporator of such a type has been known (see Japanese Patent Application Laid-Open (kokai) No. 2009-156532). The known evaporator comprises leeward and windward tube rows each of which is composed of a plurality of heat exchange tubes disposed such that their longitudinal direction coincides with the vertical direction and they are spaced from one another in the left-right direction, and which are disposed side by side in the air-passage direction; leeward upper and lower headers with which upper and lower end portions of the heat exchange tubes of the leeward tube row communicate, respectively; and windward upper and lower headers with which upper and lower end portions of the heat exchange tubes of the windward tube row communicate, respectively. In the two tube rows, descending flow tube groups each of which is composed of a plurality of heat exchange tubes and in which refrigerant flows from the upper side toward the lower side and ascending flow tube groups each of which is composed of a plurality of heat exchange tubes and in which the refrigerant flows from the lower side toward the upper side are arranged alternately. The leeward tube row includes three tube groups, and the windward tube row includes two tube groups. A refrigerant inlet is provided at one end of the leeward upper header, and a refrigerant outlet is provided at one end of the windward upper header, which one end is located on the same side as the side where the refrigerant inlet is provided. In the leeward tube row, a nearest tube group which is the nearest to the refrigerant inlet and a farthest tube group which is the farthest from the refrigerant inlet are descending flow tube groups in which the refrigerant flows from the upper side toward the lower side, and an intermediate tube group between the two descending flow tube groups is an ascending flow tube group in which the refrigerant flows from the lower side toward the upper side. In the windward tube row, a nearest tube group which is the nearest to the refrigerant outlet is an ascending flow tube group in which the refrigerant flows from the lower side toward the upper side, and a farthest tube group which is the farthest from the refrigerant outlet is a descending flow tube group. The farthest tube group of the windward tube row is disposed on the windward side of the farthest tube group of the leeward tube row, and the two farthest tube groups form a single path. An upper end portion of the farthest tube group of the leeward tube row and an upper end portion of the intermediate tube group located adjacent to and upstream of the farthest tube group in the flow direction of the refrigerant communicate with one leeward compartment which is provided in the leeward upper header and which is closed at opposite ends thereof. An upper end portion of the farthest tube group of the windward tube row communicates with one windward compartment which is provided in the windward upper header, which is closed at opposite ends thereof, and which is shorter in length in the left-right direction than the leeward compartment. The entire leeward compartment and the entire windward compartment form a single space, and a refrigerant passage section is provided so as to establish communication between the windward compartment and a portion of the leeward compartment with which the farthest tube group communicates. The refrigerant having flowed into the leeward compartment from the intermediate tube group of the leeward tube row flows toward the farthest tube group side, flows downward within the heat exchange tubes of the farthest tube group. Simultaneously with this, the refrigerant having flowed into the leeward compartment from the intermediate tube group of the leeward tube row flows into the windward compartment through the refrigerant passage section and flows downward within the heat exchange tubes of the farthest tube group of the windward tube row. The area of a half of the refrigerant passage section on the upstream side in the refrigerant flow direction in the leeward compartment is approximately the same as the area of the remaining half of the refrigerant passage section on the downstream side in the refrigerant flow direction.

In the evaporator disclosed in the above-mentioned publication, when the refrigerant having flowed from the intermediate tube group of the leeward tube row into the leeward compartment of the leeward upper header flows toward the farthest tube group of the leeward tube row, due to inertia, the refrigerant tends to flow to the deeper side (the downstream side in the flow direction in the leeward compartment). As a result, the amount of the refrigerant flowing into the heat exchange tubes of the two farthest tube groups forming the single path, which tubes are located on the downstream side in the refrigerant flow direction in the leeward compartment and the windward compartment, increases, whereby the amounts of the refrigerant flowing in the heat exchange tubes of the two farthest tube groups become non-uniform.

Therefore, in order to improve cooling performance, it is desired to equalize the amounts of the refrigerant flowing in the heat exchange tubes of the farthest tube groups of the leeward tube row and the windward tube row which are the same in terms of the flow direction of the refrigerant within the heat exchange tubes.

In view of the foregoing, the present applicant has proposed an evaporator of the above-described type in which a promoting member for promoting the flow of the refrigerant from the leeward compartment into the windward compartment is provided in the leeward upper header (see Japanese Patent Application Laid-Open (kokai) No. 2012-197974).

However, in the evaporator disclosed in the second publication, the promoting member may increase pressure loss. Also, since a process for providing the promoting member is needed, the work for manufacturing the evaporator becomes troublesome.

SUMMARY OF THE INVENTION

An object of the present invention is to solve the above problem and to provide an evaporator which can enhance cooling performance by equalizing the amounts of refrigerant flowing in heat exchange tubes of two descending flow tube groups which are provided side-by-side in an air-passage direction and form a single path.

An evaporator according to the present invention comprises a first upper header; a first lower header disposed below the first upper header to be parallel to the first upper header; a plurality of first heat exchange tubes which are disposed between the first upper header and the first lower header and whose upper and lower end portions are connected to the first upper header and the first lower header, respectively; a first descending flow tube group which is composed of a plurality of the first heat exchange tubes and in which refrigerant flows from an upper side toward a lower side thereof; a first ascending flow tube group which is composed of a plurality of the first heat exchange tubes, in which the refrigerant flows from a lower side toward an upper side thereof, and which is provided adjacent to the first descending flow tube group; a first compartment which is provided in the first upper header and with which an upper end portion of the first descending flow tube group communicates; and a second compartment which is provided in the first upper header to be located adjacent to the first compartment, with which an upper end portion of the first ascending flow tube group communicates, and from which the refrigerant flows out toward the first compartment. Also, the evaporator according to the present invention comprises a second upper header disposed to be parallel to the first upper header; a second lower header disposed below the second upper header to be parallel to the second upper header and the first lower header; a plurality of second heat exchange tubes which are disposed between the second upper header and the second lower header and whose upper and lower end portions are connected to the second upper header and the second lower header, respectively; a second descending flow tube group which is composed of a plurality of the second heat exchange tubes, in which the refrigerant flows from an upper side toward a lower side thereof, and which is provided next to the first descending flow tube group in an air-passage direction; a third compartment which is provided in the second upper header and with which an upper end portion of the second descending flow tube group communicates; and a first flow distribution control section which is provided between the first compartment and the third compartment and which has a first refrigerant passage section for establishing communication between the first compartment and the third compartment. A first portion of the first refrigerant passage section located on a side toward the second compartment has an area greater than that of a second portion of the first refrigerant passage section located on a side opposite the second compartment.

DESCRIPTION OF THE PREFERRED EMBODIMENT

Figure 1:
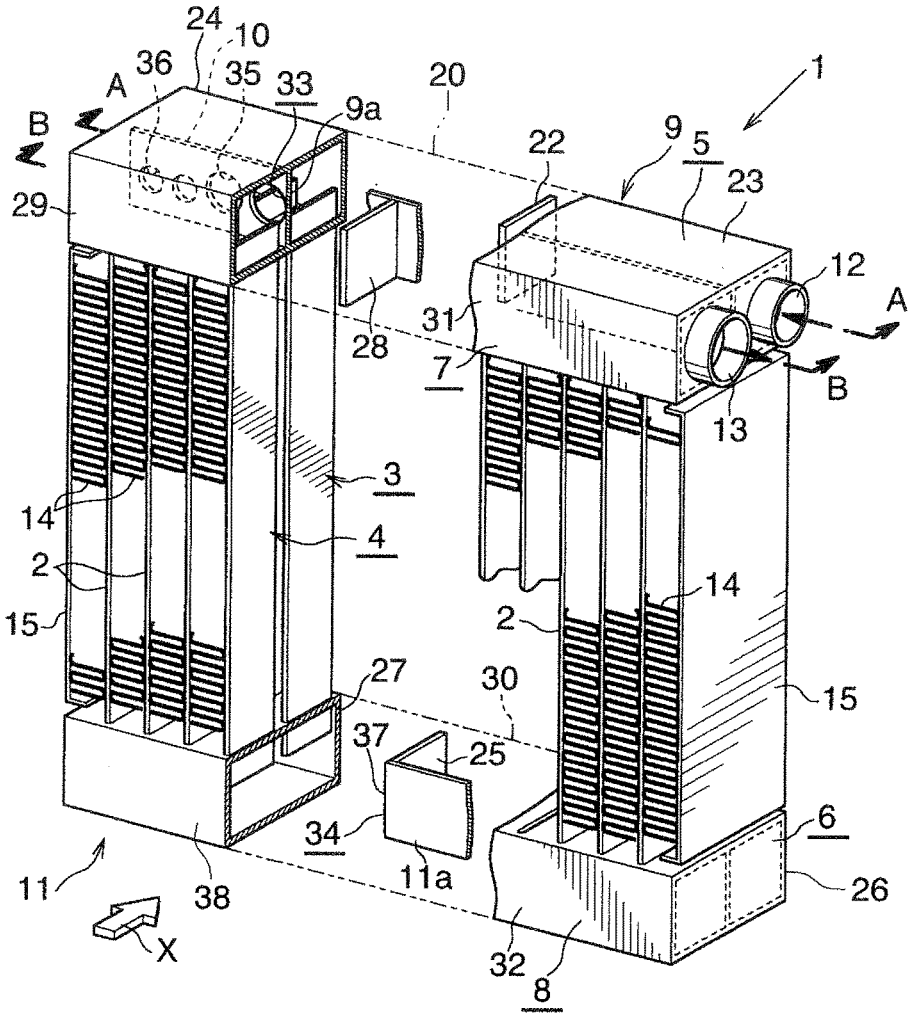
FIG. 1 is a partially cut-away perspective view showing the overall structure of an evaporator according to the present invention.

An embodiment of the present invention will next be described with reference to the drawings. In the embodiment which will be described below, the evaporator of the present invention is applied to a refrigeration cycle which constitutes a car air conditioner.

Like portions and members are denoted by like reference numerals throughout the drawings, and repeated description is not provided.

In the following description, the term "aluminum" encompasses aluminum alloys in addition to pure aluminum.

FIGS. 1 to 4 show the overall structure of the evaporator of the present invention, and FIGS. 5 to 8 show the configurations of essential portions of the evaporator. Notably, in FIG. 2, heat exchange tubes, fins, etc. are not illustrated.

As shown in FIGS. 1 to 4, an evaporator 1 includes a leeward upper header 5 (first upper header) which is formed of aluminum and whose longitudinal direction coincides with a left-right direction; a leeward lower header 6 (first lower header) which is formed of aluminum, whose longitudinal direction coincides with the left-right direction, and which is disposed below the leeward upper header 5 to be parallel to the leeward upper header 5; a windward upper header 7 (second upper header) which is formed of aluminum, whose longitudinal direction coincides with the left-right direction, and which is disposed on the windward side of the leeward upper header 5 to be parallel to the leeward upper header 5; a windward lower header 8 (second lower header) which is formed of aluminum, whose longitudinal direction coincides with the left-right direction, and which is disposed below the windward upper header 7 and on the windward side of the leeward lower header 6 to be parallel to the windward upper header 7 and the leeward lower header 6; a plurality of leeward heat exchange tubes 2 (first heat exchange tubes) which are formed of aluminum and are disposed between the leeward upper header 5 and the leeward lower header 6 and whose upper and lower end portions are connected to the leeward upper header 5 and the leeward lower header 6, respectively; and a plurality of windward heat exchange tubes 2 (second heat exchange tubes) which are formed of aluminum and are disposed between the windward upper header 7 and the windward lower header 8 and whose upper and lower end portions are connected to the windward upper header 7 and the windward lower header 8, respectively.

Figure 2:
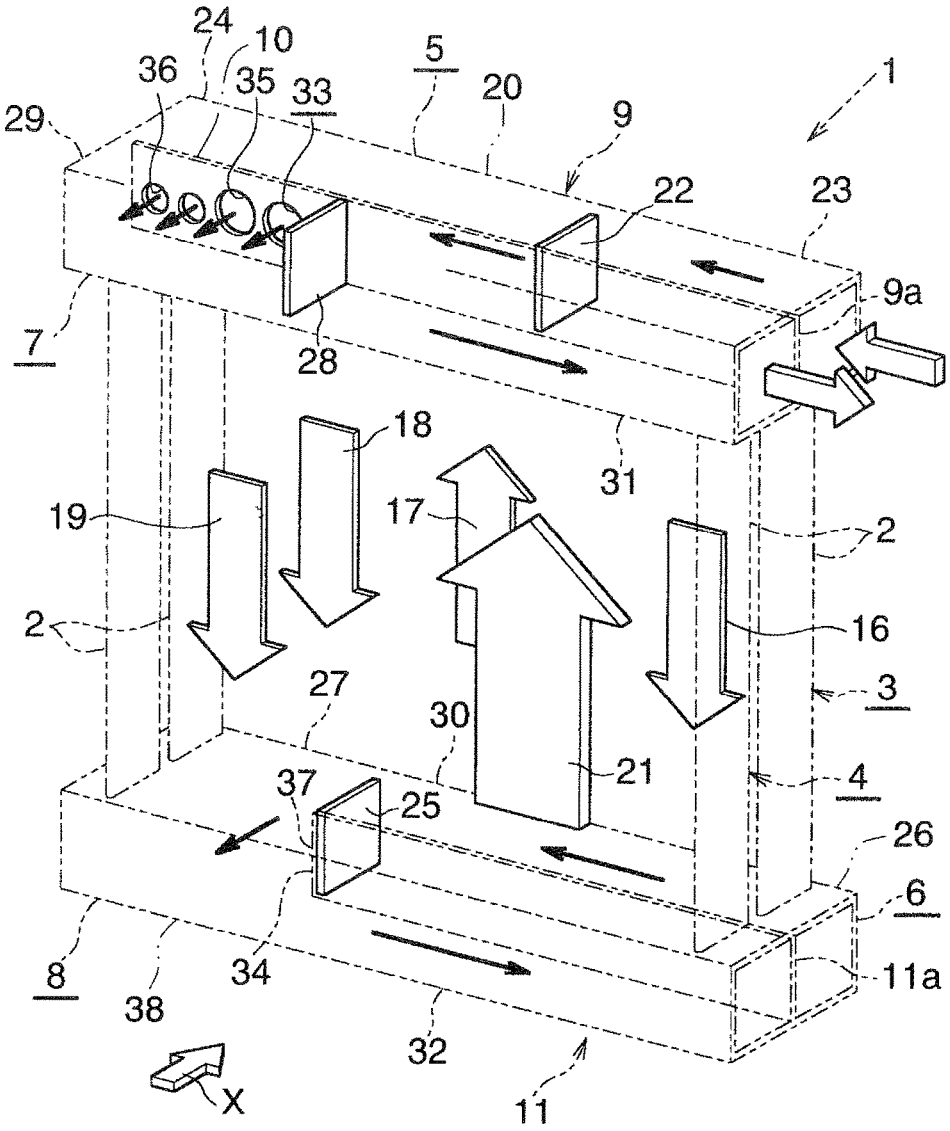
FIG. 2 is a perspective view schematically showing the overall structure of the evaporator of FIG. 1 and showing the flow of refrigerant.
Figure 3:
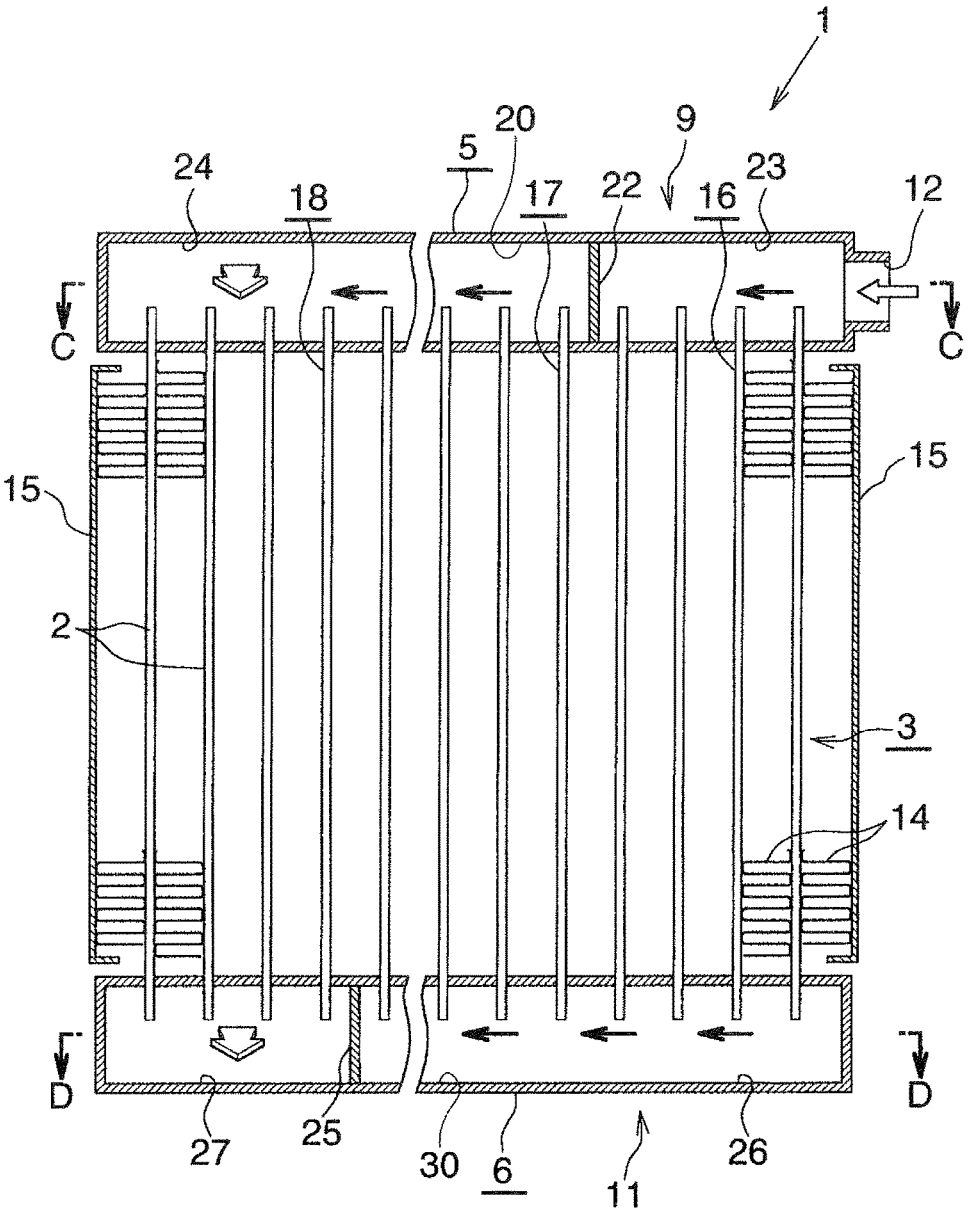
FIG. 3 is a sectional view taken along line A-A of FIG. 1.
Figure 4:
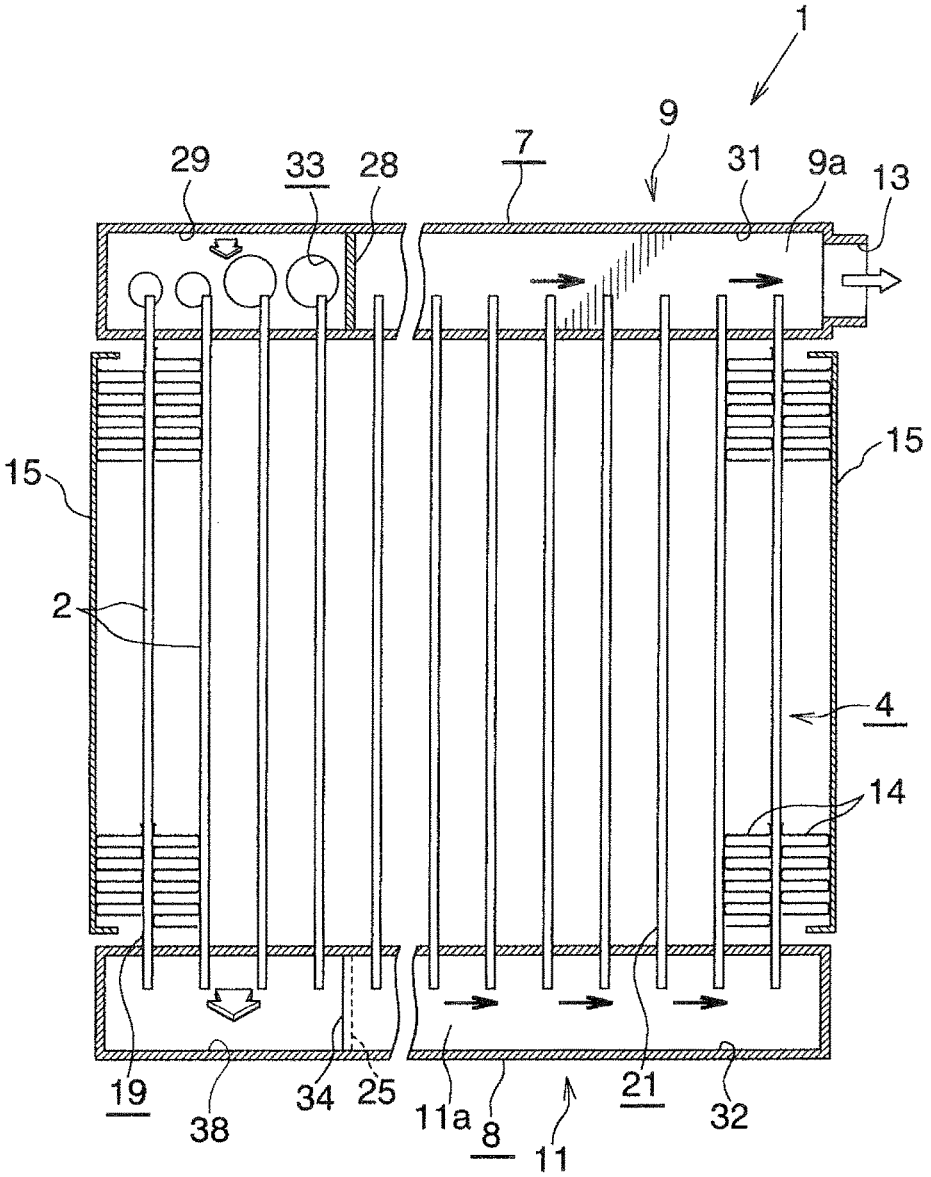
FIG. 4 is a sectional view taken along line B-B of FIG. 1.

The heat exchange tubes 2 are flat and are disposed in such a manner that their width direction coincides with the air-passage direction indicated by arrow X in FIGS. 1 and 2 and their longitudinal direction coincides with the vertical direction and that they are spaced from one another in the left-right direction (direction perpendicular to the air-passage direction). A leeward tube row 3 is formed by the heat exchange tubes 2 disposed between the leeward upper header 5 and the leeward lower header 6, and a windward tube row 4 is formed by the heat exchange tubes 2 disposed between the windward upper header 7 and the windward lower header 8.

The leeward upper header 5 and the windward upper header 7 are provided, for example, by dividing the interior of a single aluminum tank 9, in the air-passage direction, into two spaces by a plate-shaped partition portion 9*a* extending in the left-right direction. Similarly, the leeward lower header 6 and the windward lower header 8 are provided, for example, by dividing the interior of a single aluminum tank 11, in the air-passage direction, into two spaces by a plate-shaped partition portion 11*a* extending in the left-right direction. A refrigerant inlet 12 is provided at a right end portion of the leeward upper header 5, and a refrigerant outlet 13 is provided at a right end portion of the windward upper header 7. All the heat exchange tubes 2 of the leeward tube row 3 and the windward tube row 4 are joined to the two tanks 9 and 11 through use of a brazing material in a state in which their upper and lower end portions having a predetermined length are inserted into the two upper headers 5 and 7 and the two lower headers 6 and 8, respectively. In the following description, joining through use of a brazing material will be referred to as "brazing." The upper ends of all the heat exchange tubes 2 are located at the same vertical position, and the lower ends of all the heat exchange tubes 2 are located at the same vertical position. Notably, in some cases, the vertical positions of the upper ends of all the heat exchange tubes 2 may slightly differ from one another, and the vertical positions of the lower ends of all the heat exchange tubes 2 may slightly differ from one another. The number of the heat exchange tubes 2 of the leeward tube row 3 is equal to the number of the heat exchange tubes 2 of the windward tube row 4.

The evaporator 1 includes corrugated fins 14 formed of aluminum and side plates 15 formed of aluminum. Each corrugated fin 14 is disposed in air-passing clearances between adjacent heat exchange tubes 2 of the tube rows 3 and 4 or externally of the left- or right-end heat exchange tubes 2 such that the corrugated fin 14 extends over the heat exchange tubes 2 of the two tube rows 3 and 4, and is brazed to the corresponding heat exchange tubes 2. The side plates 15 are disposed externally of the left- and right-end corrugated fins 14, and are brazed to the corresponding corrugated fins 14. The spaces between the left- and right-end heat exchange tubes 2 and the corresponding side plates 15 also serve as air-passing clearances. Air having passed through the air-passing clearances between the adjacent heat exchange tubes 2 of the two tube rows 3 and 4 is fed into a passenger compartment of a vehicle on which a vehicular air conditioner is mounted.

The leeward tube row 3 includes a first descending flow tube group 18 which is composed of a plurality of successively arranged heat exchange tubes 2, in which the refrigerant flows from the upper side toward the lower side, and which is provided on the left end side (the side opposite the refrigerant inlet 12); and a first ascending flow tube group 17 which is composed of a plurality of successively arranged heat exchange tubes 2, in which the refrigerant flows from the lower side toward the upper side, and which is provided adjacent to and on the right side (the refrigerant inlet 12 side) of the first descending flow tube group 18. The windward tube row 4 includes a second descending flow tube group 19 which is composed of a plurality of successively arranged heat exchange tubes 2, in which the refrigerant flows from the upper side toward the lower side, and which is provided side by side on the windward side of the first descending flow tube group 18. Also, the leeward tube row 3 includes a third descending flow tube group 16 which is composed of a plurality of successively arranged heat exchange tubes 2, in which the refrigerant flows from the upper side toward the lower side, and which is provided adjacent to and on the right side of the first ascending flow tube group 17, and the windward tube row 4 includes a second ascending flow tube group 21 which is composed of a plurality of successively arranged heat exchange tubes 2, in which the refrigerant flows from the lower side toward the upper side, and which is provided adjacent to and on the right side of the second descending flow tube group 19.

The first descending flow tube group 18 is a farthest tube group in the leeward tube row 3 which is the farthest from the refrigerant inlet 12, and the third descending flow tube group 16 is a nearest tube group in the leeward tube row 3 which is the nearest to the refrigerant inlet 12. Also, the second descending flow tube group 19 is a farthest tube group in the windward tube row 4 which is the farthest from the refrigerant outlet 13, and the second ascending flow tube group 21 is a nearest tube group in the windward tube row 4 which is the nearest to the refrigerant outlet 13. Accordingly, descending flow tube groups each of which is composed of a plurality of heat exchange tubes 2 and in which the refrigerant flows from the upper side toward the lower side, and ascending flow tube groups each of which is composed of a plurality of heat exchange tubes 2 and in which the refrigerant flows from the lower side toward the upper side are provided in the leeward tube row 3 and the windward tube row 4 such that the descending flow tube groups and the ascending flow tube groups are alternately arranged.

The number of the heat exchange tubes 2 of the first descending flow tube group 18 of the leeward tube row 3 is equal to the number of the heat exchange tubes 2 of the second descending flow tube group 19 of the windward tube row 4. The widths of the two tube groups 18 and 19 as measured in the left-right direction are the same, and the two tube groups 18 and 19 form a single path. The total number of the heat exchange tubes 2 of the third descending flow tube group 16 and the first ascending flow tube group 17 is equal to the number of the heat exchange tubes 2 of the second ascending flow tube group 21, and the total width of the third descending flow tube group 16 and the first ascending flow tube group 17 as measured in the left-right direction is the same as the width of the second ascending flow tube group 21 as measured in the left-right direction. Each of the tube groups 16, 17, and 21 (tube groups other than the first descending flow tube group 18 and the second descending flow tube group 19) solely forms a single path.

The leeward upper header 5 has a leeward upper left compartment 24 (first compartment), a leeward upper central compartment 20 (second compartment), and a leeward upper right compartment 23. The leeward upper left compartment 24 is provided on the left end side, and the upper end portions of the heat exchange tubes 2 of the first descending flow tube group 18 communicate with the leeward upper left compartment 24. The leeward upper central compartment 20 is provided adjacent to and on the right side of the leeward upper left compartment 24, and the upper end portions of the heat exchange tubes 2 of the first ascending flow tube group 17 communicate with the leeward upper central compartment 20. The refrigerant flows out leftward from the leeward upper central compartment 20 toward the leeward upper left compartment 24. The leeward upper right compartment 23 is provided adjacent to and on the right side of the leeward upper central compartment 20, and the upper end portions of the heat exchange tubes 2 of the third descending flow tube group 16 communicate with the leeward upper right compartment 23. Since no partition is provided between the leeward upper left compartment 24 and the leeward upper central compartment 20, the refrigerant flows straight leftward from the leeward upper central compartment 20 and flows into the leeward upper left compartment 24. A plate-shaped dividing portion 22 is present between the leeward upper central compartment 20 and the leeward upper right compartment 23. The leeward upper right compartment 23 communicates with the refrigerant inlet 12.

The leeward lower header 6 has a leeward lower left compartment 27 (fourth compartment), a leeward lower central compartment 30, and a leeward lower right compartment 26. The leeward lower left compartment 27 is provided on the left end side, and the lower end portions of the heat exchange tubes 2 of the first descending flow tube group 18 communicate with the leeward lower left compartment 27. The leeward lower central compartment 30 is provided adjacent to and on the right side of the leeward lower left compartment 27, and the lower end portions of the heat exchange tubes 2 of the first ascending flow tube group 17 communicate with the leeward lower central compartment 30. The leeward lower right compartment 26 is provided adjacent to and on the right side of the leeward lower central compartment 30, and the lower end portions of the heat exchange tubes 2 of the third descending flow tube group 16 communicate with the leeward lower right compartment 26. The refrigerant flows out from the leeward lower right compartment 26 toward the leeward lower central compartment 30. A plate-shaped dividing portion 25 is present between the leeward lower left compartment 27 and the leeward lower central compartment 30. Since no partition is provided between the leeward lower central compartment 30 and the leeward lower right compartment 26, the refrigerant flows straight leftward from the leeward lower right compartment 26 and flows into the leeward lower central compartment 30.

The windward upper header 7 has a windward upper left compartment 29 (third compartment) and a windward upper right compartment 31. The windward upper left compartment 29 is provided on the left end side, and the upper end portions of the heat exchange tubes 2 of the second descending flow tube group 19 communicate with the windward upper left compartment 29. The windward upper right compartment 31 is provided adjacent to and on the right side of the windward upper left compartment 29, and the upper end portions of the heat exchange tubes 2 of the second ascending flow tube group 21 communicate with the windward upper right compartment 31. A plate-shaped dividing portion 28 is present between the windward upper left compartment 29 and the windward upper right compartment 31. The windward upper right compartment 31 communicates with the refrigerant outlet 13.

The windward lower header 8 has a windward lower left compartment 38 (fifth compartment) and a windward lower right compartment 32. The windward lower left compartment 38 is provided on the left end side, and the lower end portions of the heat exchange tubes 2 of the second descending flow tube group 19 communicate with the windward lower left compartment 38. The windward lower right compartment 32 is provided adjacent to and on the right side of the windward lower left compartment 38, and the lower end portions of the heat exchange tubes 2 of the second ascending flow tube group 21 communicate with the windward lower right compartment 32. The refrigerant from the windward lower left compartment 38 flows into the windward lower right compartment 32. Since no partition is provided between the windward lower left compartment 38 and the windward lower right compartment 32, the refrigerant flows straight rightward from the windward lower left compartment 38 and flows into the windward lower right compartment 32.

The lengths of the leeward upper left compartment 24, the leeward lower left compartment 27, the windward upper left compartment 29, and the windward lower left compartment 38 as measured in the left-right direction are equal to one another. The lengths of the leeward upper central compartment 20 and the leeward lower central compartment 30 as measured in the left-right direction are equal to each other. The lengths of the leeward upper right compartment 23 and the leeward lower right compartment 26 as measured in the left-right direction are equal to each other. Also, the lengths of the windward upper right compartment 31 and the windward lower right compartment 32 as measured in the left-right direction are equal to each other, and the lengths are equal to the sum of the lengths of the leeward upper central compartment 20 and the leeward upper right compartment 23 as measured in the left-right direction and are equal to the sum of the lengths of the leeward lower central compartment 30 and the leeward lower right compartment 26 as measured in the left-right direction.

A flow distribution control section 10 (first flow distribution control section) is provided between the leeward upper left compartment 24 and the windward upper left compartment 29. The flow distribution control section 10 is formed by a part of the partition portion 9*a* which divides the interior of the upper tank 9 into the leeward upper header 5 and the windward upper header 7, and has a refrigerant passage section 33 (first refrigerant passage section) for establishing communication between the two compartments 24 and 29.

Communication between the leeward lower left compartment 27 and the windward lower left compartment 38 is established by a lower refrigerant passage section 34 which is formed by removing a portion of the partition portion 11*a* which divides the interior of the lower tank 11 into the leeward lower header 6 and the leeward lower header 8.

The refrigerant having flowed into the evaporator 1 through the refrigerant inlet 12 flows through two paths as described below and flows out from the refrigerant outlet 13. The first path is formed by the leeward upper right compartment 23, the third descending flow tube group 16, the leeward lower right compartment 26, the leeward lower central compartment 30, the first ascending flow tube group 17, the leeward upper central compartment 20, the leeward upper left compartment 24, the first descending flow tube group 18, the leeward lower left compartment 27, the lower refrigerant passage section 34, the windward lower left compartment 38, the windward lower right compartment 32, the second ascending flow tube group 21, and the windward upper right compartment 31. The second path is formed by the leeward upper right compartment 23, the third descending flow tube group 16, the leeward lower right compartment 26, the leeward lower central compartment 30, the first ascending flow tube group 17, the leeward upper central compartment 20, the leeward upper left compartment 24, the refrigerant passage section 33, the windward upper left compartment 29, the second descending flow tube group 19, the windward lower left compartment 38, the windward lower right compartment 32, the second ascending flow tube group 21, and the windward upper right compartment 31.

Figure 5:
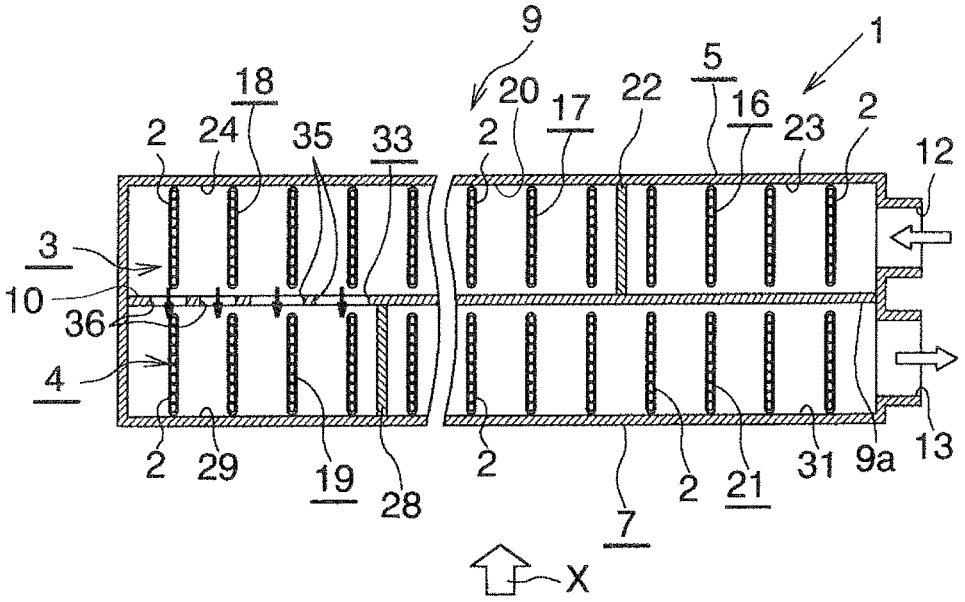
FIG. 5 is a sectional view taken along line C-C of FIG. 3.
Figure 6:
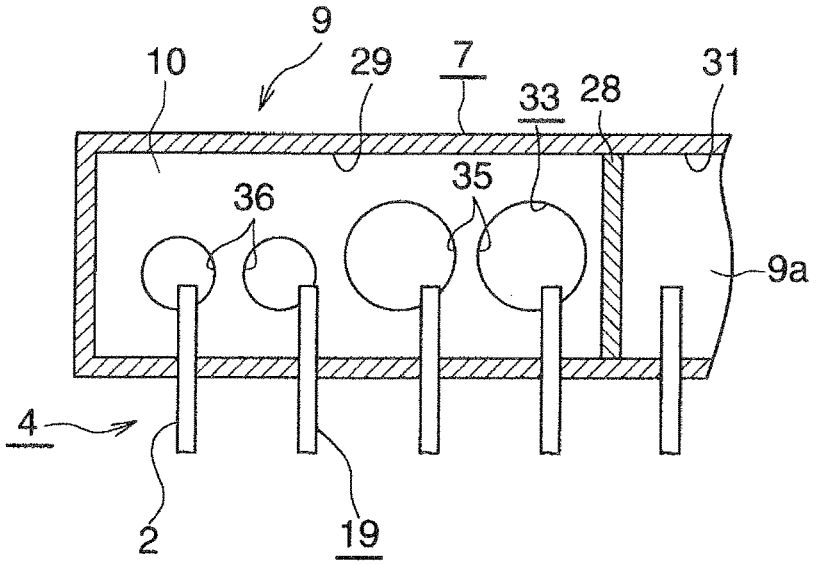
FIG. 6 is an enlarged view of a portion of FIG. 4.
Figure 7:
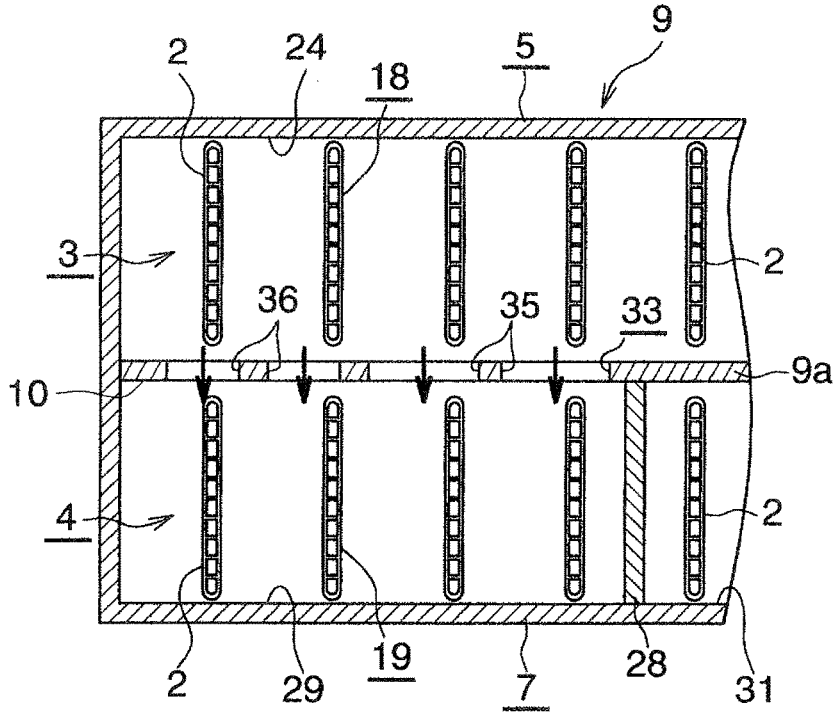
FIG. 7 is an enlarged view of a portion of FIG. 5.

As shown in FIGS. 5 to 7, a plurality of hole-like refrigerant passages 35 and 36 (first refrigerant passages) for establishing communication between the leeward upper left compartment 24 and the windward upper left compartment 29 are formed in a part of the partition portion 9*a* of the upper tank 9, which part is located between the leeward upper left compartment 24 and the windward upper left compartment 29, such that the refrigerant passages 35 and 36 are spaced from one another in the left-right direction. The refrigerant passage section 33 is formed by all the refrigerant passages 35 and 36, and the part of the partition portion 9*a* located between the two compartments 24 and 29 serves as the flow distribution control section 10 having the refrigerant passage section 33.

The refrigerant passage section 33 includes a plurality of types of refrigerant passages 35 and 36 which differ in passage area; i.e., a plurality of refrigerant passages 35 having a larger passage area and a plurality of refrigerant passages 36 having a smaller passage area. A plurality of passage sets each including a plurality of refrigerant passages 35 (36) having the same passage area are provided such that the passage sets are arranged in the left-right direction. In the passage sets located adjacent to each other in the left-right direction, the passage area of the refrigerant passages 35 of the passage set on the side toward the leeward upper central compartment 20 (on the upstream side in the refrigerant flow direction in the leeward upper left compartment 24) (hereinafter, the side toward the leeward upper central compartment 20 will be referred to as the right side) is larger than the passage area of the refrigerant passages 36 of the passage set on the side opposite the leeward upper central compartment 20 (on the downstream side in the refrigerant flow direction) (hereinafter, the side opposite the leeward upper central compartment 20 will be referred to as the left side). In the present embodiment, the refrigerant passage section 33 has two types of refrigerant passages 35 and 36 which differ in passage area; i.e., two refrigerant passages 35 having a larger passage area and two refrigerant passages 36 having a smaller passage area. As a result, the area of a right side portion of the refrigerant passage section 33 is greater than the area of a left side portion of the refrigerant passage section 33.

Also, the lower ends of all the refrigerant passages 35 and 36 of the refrigerant passage section 33 are located at the same vertical position, and the lower ends of all the refrigerant passages 35 and 36 (namely, the lower end of the refrigerant passage section 33) are located at a vertical position below the upper ends of all the heat exchange tubes 2 of the first and second descending flow tube groups 18 and 19 which form one path. Further, the total area of the refrigerant passages 35 and 36 of the refrigerant passage section 33 is greater than the total passage sectional area of the refrigerant passages of all the heat exchange tubes 2 of the first descending flow tube group 18.

Notably, one refrigerant passage may extend across a center portion (in the left-right direction) of the flow distribution control section 10 between the leeward upper left compartment 24 and the windward upper left compartment 29. In such a case, for consideration, the area of that refrigerant passage is divided into the area of a left side portion of the refrigerant passage and the area of a right side portion of the refrigerant passage.

Figure 8:
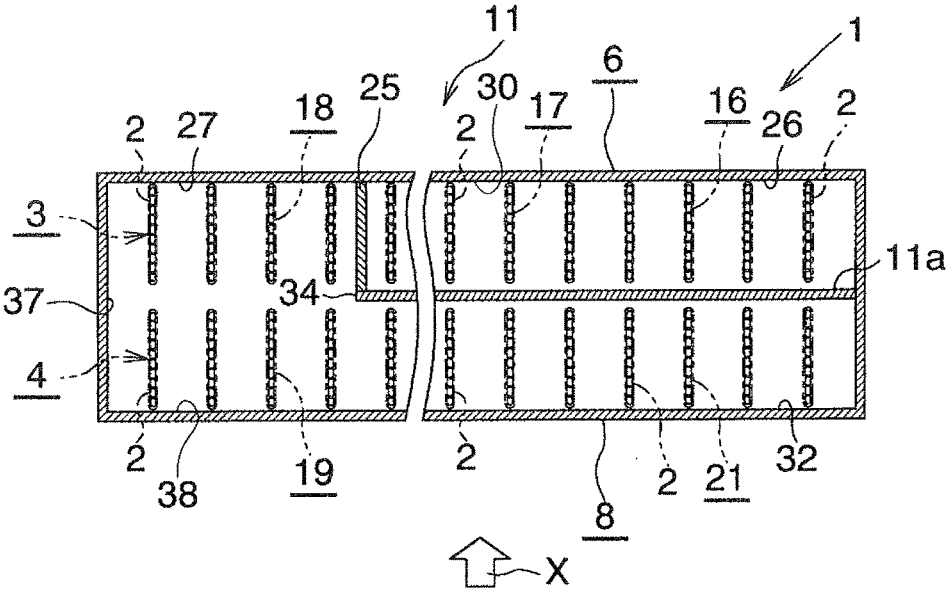
FIG. 8 is a sectional view taken along line D D of FIG. 3.

As shown in FIG. 8, the lower refrigerant passage section 34 is composed of a single hole-like refrigerant passage 37 which is formed by removing a part of the partition portion 11*a* which divides the interior of the lower tank 11 into the leeward lower header 6 and the leeward lower header 8, the part extending over the entire lengths of the leeward lower left compartment 27 and the windward lower left compartment 38. The refrigerant passage 37 is formed over the entire heights and entire lengths of the two compartments 27 and 38. Therefore, the passage area of a left half of the refrigerant passage 37 located on the upstream side in the refrigerant flow direction in the windward lower right compartment 32 is equal to the passage area of a right half of the refrigerant passage 37 located on the downstream side in the refrigerant flow direction in the windward lower right compartment 32. As a result, the area of a half of the lower refrigerant passage section 34 located on the upstream side in the refrigerant flow direction in the windward lower right compartment 32 is equal to the area of the remaining half of the lower refrigerant passage section 34 located on the downstream side in the refrigerant flow direction. Also, the upper end of the refrigerant passage 37 of the lower refrigerant passage section 34 is located at a vertical position above the lower ends of all the heat exchange tubes 2 of the first and second descending flow tube groups 18 and 19.

The above-described evaporator 1, together with a compressor, a condenser serving as a refrigerant cooler, and an expansion valve serving as a pressure reducer, constitutes a refrigeration cycle which is installed in a vehicle, such as an automobile, as a car air conditioner. When the car air conditioner is operated, the refrigerant having passed through the compressor, the condenser, and the expansion valve enters the evaporator 1 through the refrigerant inlet 12. The refrigerant then flows through the above-described two paths and flows out from the refrigerant outlet 13. While the refrigerant flows through the heat exchange tubes 2 of the leeward tube row 3 and the heat exchange tubes 2 of the windward tube row 4, heat exchange is performed between the refrigerant and air passing through the air-passing clearances between the adjacent heat exchange tubes 2, whereby the air is cooled, and the refrigerant flows out in the vapor phase.

In the evaporator 1, the area of a portion of the refrigerant passage section 33 of the flow distribution control section 10, which portion is located on the right side; i.e., on the upstream side in the refrigerant flow direction in the leeward upper left compartment 24, is greater than the area of a portion of the refrigerant passage section 33 of the flow distribution control section 10, which portion is located on the left side; i.e., the downstream side in the refrigerant flow direction. The resistance acting on the refrigerant when the refrigerant passes through the right side portion of the refrigerant passage section 33 is smaller than the resistance acting on the refrigerant when the refrigerant passes through the left side portion of the refrigerant passage section 33. Therefore, the following advantageous effect is obtained. Namely, when the refrigerant having flowed from the first ascending flow tube group 17 into the leeward upper central compartment 20 flows toward the leeward upper left compartment 24 side, due to inertia, a larger amount of the refrigerant tends to flow toward the deeper side (the left side). However, by virtue of the configuration of the refrigerant passage section 33 of the flow distribution control section 10, the amount of the refrigerant passing through the right side portion of the refrigerant passage section 33 and the amount of the refrigerant passing through the left side portion of the refrigerant passage section 33 are equalized. As a result, the amounts of the refrigerant flowing in all the heat exchange tubes 2 of the first descending flow tube group 18 and the second descending flow tube group 19 which form a single path can be equalized, whereby the cooling performance of the evaporator 1 becomes excellent.

Also, since the total area of all the refrigerant passage 35 and 36 of the refrigerant passage section 33 is greater than the total passage sectional area of the refrigerant passages of all the heat exchange tubes 2 of the first descending flow tube group 18, even when the refrigerant having flowed into the leeward upper central compartment 20 from the first ascending flow tube group 17 greatly receives the influence of gravitational force when flowing toward the leeward upper left compartment 24 side, the amount of the refrigerant flowing into the heat exchange tubes 2 of the first descending flow tube group 18 is decreased, and the flow of the refrigerant flowing into the heat exchange tubes 2 of the second descending flow tube group 19 through the refrigerant passage section 33 and the windward upper left compartment 29 is promoted. As a result, in this case as well, the amounts of the refrigerant flowing in all the heat exchange tubes 2 of the first descending flow tube group 18 and the second descending flow tube group 19 which form a single path can be equalized, whereby the cooling performance of the evaporator 1 becomes excellent.

Figure 9:
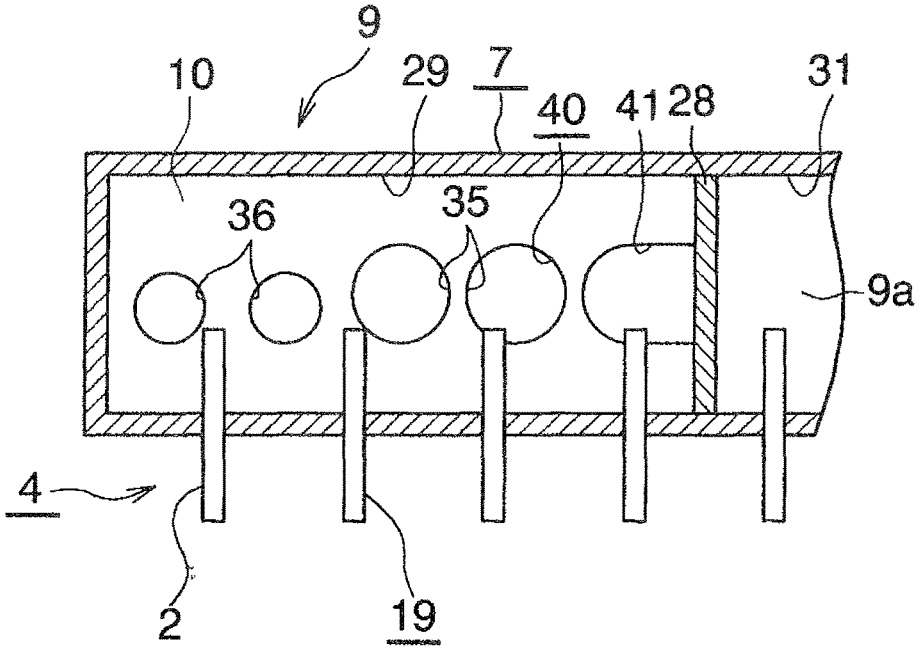
FIG. 9 is a view corresponding to FIG. 6 and showing a modification of a refrigerant passage section formed in a flow distribution control section.
Figure 10:
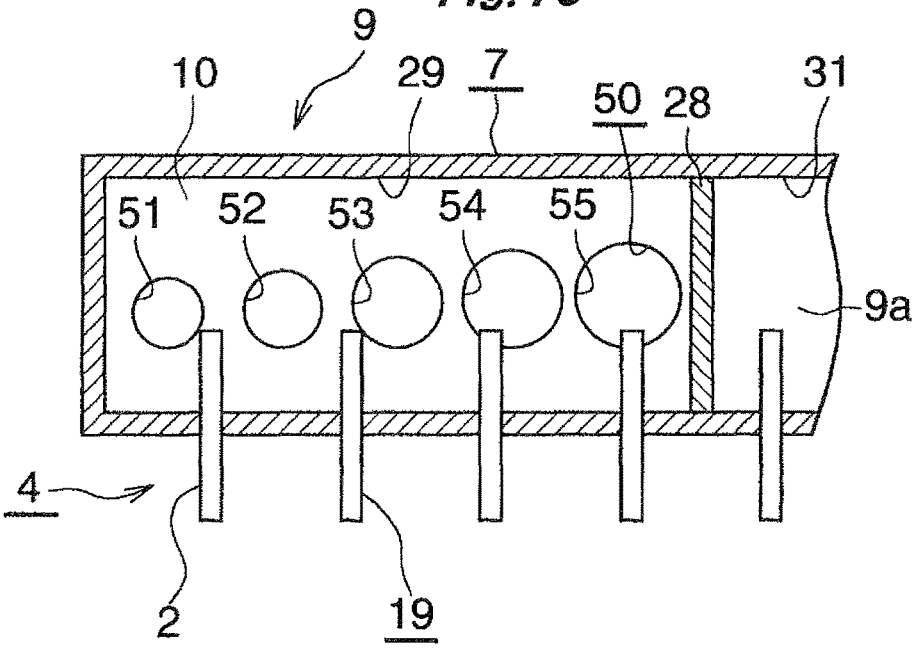
FIG. 10 is a view corresponding to FIG. 6 and showing another modification of the refrigerant passage section formed in the flow distribution control section.

FIGS. 9 and 10 show modifications of the refrigerant passage section formed in the flow distribution control section 10.

In the case of a refrigerant passage section 40 shown in FIG. 9, a hole-like refrigerant passage 41 (first refrigerant passage) is formed at the right end of the flow distribution control section 10. The refrigerant passage 41 is located on the right side of the right-side refrigerant passage 35 of the right-side passage set. The right end edge of the refrigerant passage 41 extends vertically and coincides with the left side surface of the dividing portion 28 between the windward upper left compartment 29 and the windward upper right compartment 31.

Also, the lower ends of all the refrigerant passages 35, 36, and 41 of the refrigerant passage section 40 are located at the same vertical position, and the lower ends of all the refrigerant passages 35, 36, and 41 (namely, the lower end of the refrigerant passage section 40) are located at a vertical position below the upper ends of all the heat exchange tubes 2 of the first and second descending flow tube groups 18 and 19 which form one path. Further, the total area of all the refrigerant passages 35, 36, and 41 of the refrigerant passage section 40 is greater than the total passage sectional area of the refrigerant passages of all the first heat exchange tubes 2 of the first descending flow tube group 18.

In the case of a refrigerant passage section 50 shown in FIG. 10, a plurality of hole-like refrigerant passages 51, 52, 53, 54, and 55 (first refrigerant passages) for establishing communication between the leeward upper left compartment 24 and the windward upper left compartment 29 are formed in the flow distribution control section 10 such that they are spaced from one another in the left-right direction. The refrigerant passage section 50 is formed by all the refrigerant passages 51, 52, 53, 54, and 55. The all the refrigerant passages 51, 52, 53, 54, and 55 have different passage areas gradually increasing from the left side (downstream side in the refrigerant flow direction in the leeward upper left compartment 24) toward the right side (upstream side in the refrigerant flow direction). As a result, the total passage area of the refrigerant passages 53, 54, and 55 present in the right half of the flow distribution control section 10 is greater than the total passage area of the refrigerant passages 51, 52, and 53 present in the left half of the flow distribution control section 10. Thus, the area of the right half of the refrigerant passage section 50 is greater than the area of the left half of the refrigerant passage section 50.

Also, the lower ends of all the refrigerant passages 51, 52, 53, 54, and 55 of the refrigerant passage section 50 are located at the same vertical position, and the lower ends of all the refrigerant passages 51, 52, 53, 54, and 55 (namely, the lower end of the refrigerant passage section 50) are located at a vertical position below the upper ends of all the heat exchange tubes 2 of the first and second descending flow tube groups 18 and 19 which form one path. Further, the total area of all the refrigerant passages 51, 52, 53, 54, and 55 of the refrigerant passage section 50 is greater than the total passage sectional area of the refrigerant passages of all the heat exchange tubes 2 of the first descending flow tube group 18.

Notably, in FIG. 10, one refrigerant passage 53 extends across a center portion (in the refrigerant flow direction) of the leeward upper left compartment 24. In such a case, for consideration, the area of the refrigerant passage 53 is divided into the area of a portion of the refrigerant passage 53 on the upstream side in the refrigerant flow direction in the leeward upper left compartment 24 and the area of a portion of the refrigerant passage 53 on the downstream side in the refrigerant flow direction.

Figure 11:
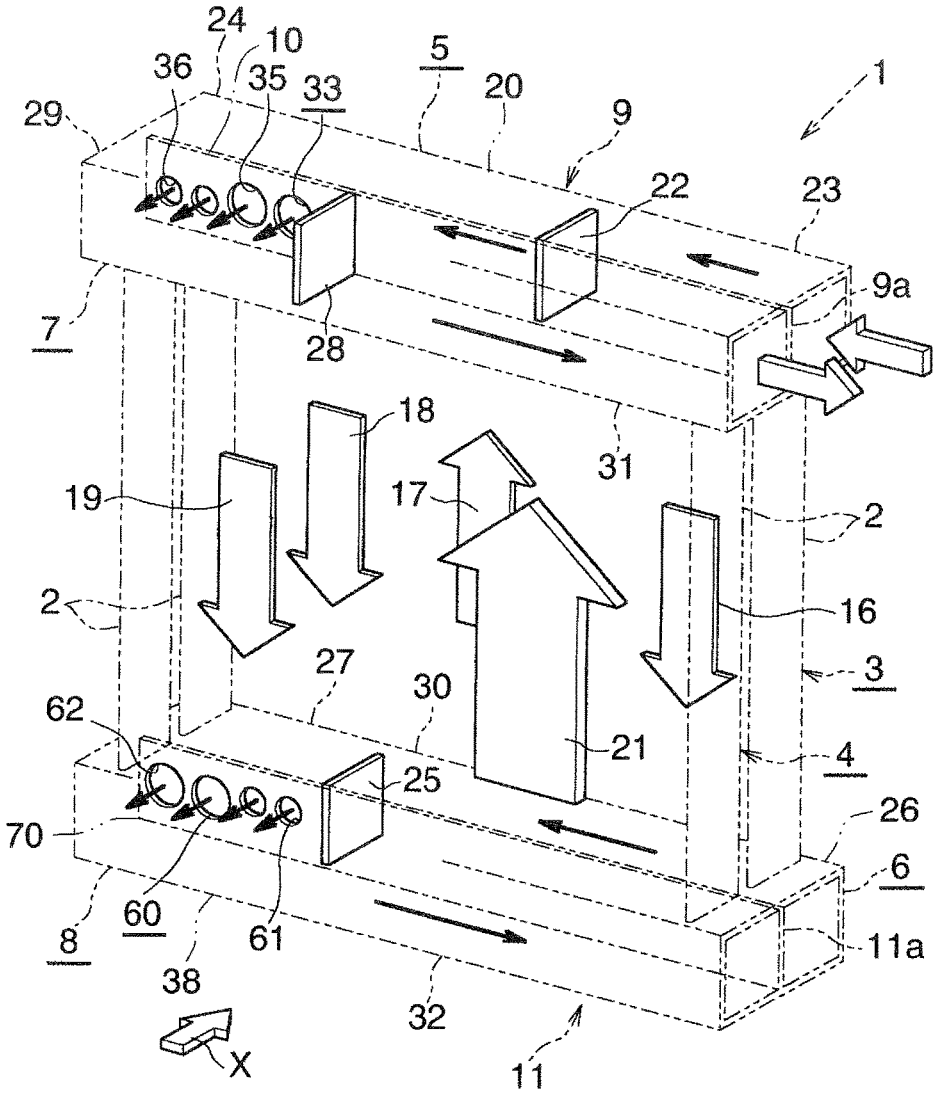
FIG. 11 is a view corresponding to FIG. 2 and showing a modification of a lower flow distribution control section.
Figure 12:
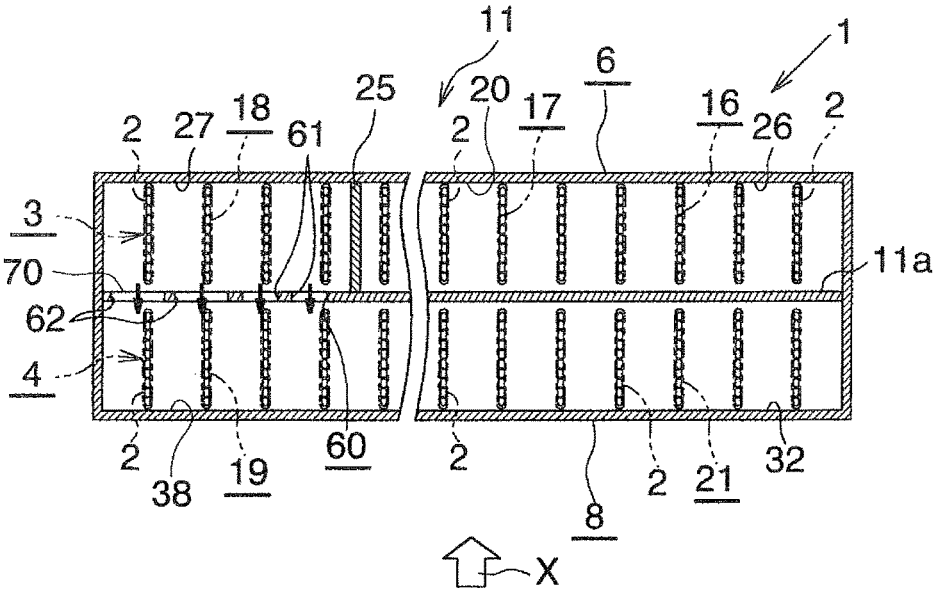
FIG. 12 is a view corresponding to FIG. 8 and showing the lower flow distribution control section of FIG. 11.
Figure 13:
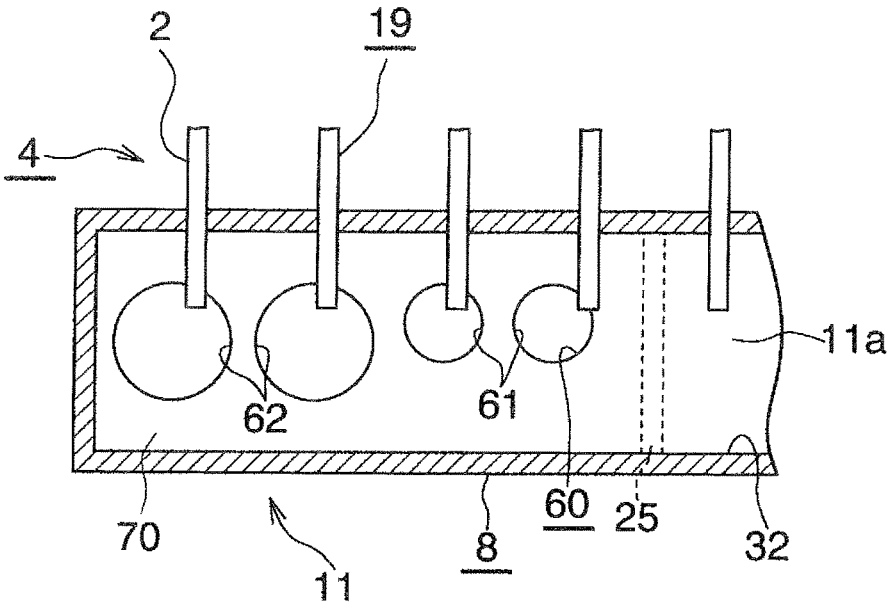
FIG. 13 is a partial enlarged view of the lower flow distribution control section of FIG. 11 as viewed from the windward side.

FIGS. 11 to 13 show a modification of the lower refrigerant passage section which establishes communication between the leeward lower left compartment 27 of the leeward lower header 6 and the windward lower left compartment 38 of the windward lower header 8.

As shown in FIGS. 11 to 13, a plurality of hole-like refrigerant passages 61 and 62 (second refrigerant passages) for establishing communication between the leeward lower left compartment 27 and the windward lower left compartment 38 are formed in a part of the partition portion 11*a* of the lower tank 11, which part is located between the leeward lower left compartment 27 and the windward lower left compartment 38, such that the refrigerant passages 61 and 62 are spaced from one another in the left-right direction. A lower refrigerant passage section 60 (second refrigerant passage section) for establishing communication between the two compartments 27 and 38 is formed by all the refrigerant passages 61 and 62, and the part of the partition portion 11*a* located between the two compartments 27 and 38 serves as a lower flow distribution control section 70 (second flow distribution control section).

The lower refrigerant passage section 60 includes a plurality of types of refrigerant passages 61 and 62 which differ in passage area; i.e., a plurality of refrigerant passages 61 having a smaller passage area and a plurality of refrigerant passages 62 having a larger passage area. A plurality of passage sets each including a plurality of refrigerant passages 61 (62) having the same passage area are provided such that the passage sets are arranged in the left-right direction. In the passage sets located adjacent to each other in the left-right direction, the passage area of the refrigerant passages 61 of the passage set on the right side (on the upstream side in the refrigerant flow direction in the leeward upper left compartment 24) is smaller than the passage area of the refrigerant passages 62 of the passage set on the left side (on the downstream side in the refrigerant flow direction in the leeward upper left compartment 24). In the present embodiment, the lower refrigerant passage section 60 has two types of refrigerant passages 61 and 62 which differ in passage area; i.e., two refrigerant passages 61 having a smaller passage area and two refrigerant passages 62 having a larger passage area. As a result, the total passage area of the refrigerant passages 61 present in a right half portion of the lower refrigerant passage section 60 on the upstream side in the refrigerant flow direction in the leeward upper left compartment 24 is smaller than the total passage area of the refrigerant passages 62 present in a left half portion of the lower refrigerant passage section 60 on the downstream side in the refrigerant flow direction in the leeward upper left compartment 24. Thus, the area of the right side portion of the lower refrigerant passage section 60 is smaller than the area of the left side portion of the lower refrigerant passage section 60.

Also, the upper ends of all the refrigerant passages 61 and 62 of the lower refrigerant passage section 60 are located at the same vertical position, and the upper ends of all the refrigerant passages 61 and 62 (namely, the upper end of the lower refrigerant passage section 60) are located at a vertical position above the lower ends of all the heat exchange tubes 2 of the first and second descending flow tube groups 18 and 19 which form one path.

Notably, one refrigerant passage may be present across a center portion (in the left-right direction) of the lower flow distribution control section 70. In such a case, for consideration, the area of that refrigerant passage is divided into the area of a left side portion of the refrigerant passage and the area of a right side portion of the refrigerant passage.

The present invention comprises the following modes.

1) An evaporator comprising:

a first upper header;

a first lower header disposed below the first upper header to be parallel to the first upper header;

a plurality of first heat exchange tubes which are disposed between the first upper header and the first lower header and whose upper and lower end portions are connected to the first upper header and the first lower header, respectively;

a first descending flow tube group which is composed of a plurality of the first heat exchange tubes and in which refrigerant flows from an upper side toward a lower side thereof;

a first ascending flow tube group which is composed of a plurality of the first heat exchange tubes, in which the refrigerant flows from a lower side toward an upper side thereof, and which is provided adjacent to the first descending flow tube group;

a first compartment which is provided in the first upper header and with which an upper end portion of the first descending flow tube group communicates;

a second compartment which is provided in the first upper header to be located adjacent to the first compartment, with which an upper end portion of the first ascending flow tube group communicates, and from which the refrigerant flows out toward the first compartment;

a second upper header disposed to be parallel to the first upper header;

a second lower header disposed below the second upper header to be parallel to the second upper header and the first lower header;

a plurality of second heat exchange tubes which are disposed between the second upper header and the second lower header and whose upper and lower end portions are connected to the second upper header and the second lower header, respectively;

a second descending flow tube group which is composed of a plurality of the second heat exchange tubes, in which the refrigerant flows from an upper side toward a lower side thereof, and which is provided next to the first descending flow tube group in an air-passage direction;

a third compartment which is provided in the second upper header and with which an upper end portion of the second descending flow tube group communicates; and a first flow distribution control section which is provided between the first compartment and the third compartment and which has a first refrigerant passage section for establishing communication between the first compartment and the third compartment, wherein a first portion of the first refrigerant passage section located on a side toward the second compartment has an area greater than that of a second portion of the first refrigerant passage section located on a side opposite the second compartment.

2) The evaporator described in par. 1), wherein the first refrigerant passage section has a lower end which is located at a vertical position below upper ends of all the first heat exchange tubes of the first descending flow tube group and upper ends of all the second heat exchange tubes of the second descending flow tube group.

3) The evaporator described in par. 1), wherein the first refrigerant passage section is composed of a plurality of first refrigerant passages formed in the first flow distribution control section such that the first refrigerant passages are spaced from one another in a longitudinal direction of the two upper headers;

a plurality of passage sets each composed of a plurality of the first refrigerant passages having the same passage area are arranged in the longitudinal direction of the two upper headers; and in the passage sets located adjacent to each other in the longitudinal direction of the two upper headers, the passage area of the first refrigerant passages of the passage set on the side toward the second compartment is greater than the passage area of the first refrigerant passages of the passage set on the side opposite the second compartment.

4) The evaporator described in par. 3), wherein lower ends of all the first refrigerant passages of the first refrigerant passage section are located at the same vertical position; and the lower ends of all the first refrigerant passages are located at a vertical position below upper ends of all the first heat exchange tubes of the first descending flow tube group and upper ends of all the second heat exchange tubes of the second descending flow tube group.

5) The evaporator described in par. 1), wherein the first refrigerant passage section is composed of a plurality of first refrigerant passages formed in the first flow distribution control section such that the first refrigerant passages are spaced from one another in a longitudinal direction of the two upper headers; and all the first refrigerant passages have different passage areas gradually increasing from the side opposite the second compartment toward the second compartment side.

6) The evaporator described in par. 5), wherein lower ends of all the first refrigerant passages of the first refrigerant passage section are located at the same vertical position; and the lower ends of all the first refrigerant passages are located at a vertical position below upper ends of all the first heat exchange tubes of the first descending flow tube group and upper ends of all the second heat exchange tubes of the second descending flow tube group.

7) The evaporator described in par. 1), further comprising:

a fourth compartment which is provided in the first lower header and with which a lower end portion of the first descending flow tube group communicates;

a second ascending flow tube group which is composed of a plurality of the second heat exchange tubes, in which the refrigerant flows from a lower side toward an upper side thereof, and which is provided adjacent to the second descending flow tube group;

a fifth compartment which is provided in the second lower header and with which a lower end portion of the second descending flow tube group communicates;

a sixth compartment which is provided in the second lower header to be located adjacent to the fifth compartment, with which a lower end portion of the second ascending flow tube group communicates, and into which the refrigerant flows from the fifth compartment; and a second flow distribution control section which is provided between the fourth compartment and the fifth compartment and which has a second refrigerant passage section for establishing communication between the fourth compartment and the fifth compartment, wherein a first portion of the second refrigerant passage section located on a side toward the sixth compartment has an area smaller than that of a second portion of the second refrigerant passage section located on a side opposite the sixth compartment.

8) The evaporator described in par. 7), wherein the second refrigerant passage section has an upper end which is located at a vertical position above lower ends of all the first heat exchange tubes of the first descending flow tube group and lower ends of all the second heat exchange tubes of the second descending flow tube group.

9) The evaporator described in par. 7), wherein the second refrigerant passage section is composed of a plurality of second refrigerant passages formed in the second flow distribution control section such that the second refrigerant passages are spaced from one another in a longitudinal direction of the two lower headers; and all the second refrigerant passages have different passage areas gradually decreasing from the side opposite the sixth compartment toward the sixth compartment side.

10) The evaporator described in par. 9), wherein upper ends of all the second refrigerant passages of the second refrigerant passage section are located at the same vertical position; and the upper ends of all the second refrigerant passages are located at a vertical position above lower ends of all the first heat exchange tubes of the first descending flow tube group and lower ends of all the second heat exchange tubes of the second descending flow tube group.

11) The evaporator described in par. 1), wherein the total area of the first refrigerant passage section is greater than the total passage sectional area of the refrigerant passages of all the first heat exchange tubes of the first descending flow tube group.

12) The evaporator described in par. 1), wherein the first upper header is disposed on a leeward side of the second upper header, and the first lower header is disposed on a leeward side of the second lower header.

13) The evaporator described in par. 1), wherein a refrigerant inlet is provided at one end of the first upper header, and a refrigerant outlet is provided at one end of the second upper header, which end is located on the same side as the refrigerant inlet; and the first descending flow tube group and the second descending flow tube group are provided on a side opposite the refrigerant inlet and the refrigerant outlet.

According to the evaporators of pars. 1) to 13), a first flow distribution control section is provided between the first compartment and the third compartment and has a first refrigerant passage section for establishing communication between the first compartment and the third compartment, and a first portion of the first refrigerant passage section located on a side toward the second compartment has an area greater than that of a second portion of the first refrigerant passage section located on a side opposite the second compartment. Therefore, the resistance acting on the refrigerant when the refrigerant passes through a portion of the refrigerant passage section located on the second compartment side (on the upstream side in the refrigerant flow direction) is smaller than the resistance acting on the refrigerant when the refrigerant passes through a portion of the refrigerant passage section located on the side opposite the second compartment (on the downstream side in the refrigerant flow direction). When the refrigerant having flowed from the first ascending flow tube group into the second compartment flows toward the first compartment side, due to inertia, a larger amount of the refrigerant tends to flow toward the deeper side of the first compartment. However, the configuration of the first refrigerant passage section of the first flow distribution control section equalizes the amount of the refrigerant passing through a half of the refrigerant passage section located on the upstream side in the refrigerant flow direction in the second compartment and the amount of the refrigerant passing through a half of the refrigerant passage section located on the downstream side in the refrigerant flow direction in the second compartment. As a result, the amounts of the refrigerant flowing in all the heat exchange tubes of the first and second descending flow tube groups disposed side-by-side in the air-passage direction can be equalized. Therefore, the cooling performance of the evaporator becomes excellent.

In addition, since it is unnecessary to provide a promoting member as in the case of the evaporator disclosed in the above second publication, it is possible to prevent an increase in pressure loss, which increase would otherwise occur due to presence of a promoting member. Further, since a process for providing a promoting member becomes unnecessary, work for manufacturing the evaporator becomes easier.

According to the evaporators of pars. 2) and 6), the refrigerant flows more easily into the second descending flow tube group than into the first descending flow tube group. Therefore, the amounts of the refrigerant flowing in all the heat exchange tubes of the first and second descending flow tube groups can be equalized, so that the cooling performance of the evaporator becomes excellent.

According to the evaporator of par. 7), the refrigerant having flowed into the fourth compartment from the first descending flow tube group receives a larger resistance when the refrigerant passes through a half of the lower refrigerant passage section located on the upstream side in the refrigerant flow direction in the first compartment, as compared with the case where the refrigerant passes through a half of the lower refrigerant passage section located on the downstream side in the refrigerant flow direction in the first compartment. Therefore, when the refrigerant having flowed into the second compartment from the first ascending flow tube group flows toward the first compartment side and flows into the heat exchange tubes of the first descending flow tube group, the refrigerant is restrained from flowing in a larger amount into the heat exchange tubes of the first descending flow tube group located on the second compartment side due to the influence of gravitational force. As a result, the amounts of the refrigerant flowing in all the heat exchange tubes of the first descending flow tube group can be equalized.

According to the evaporator of pars. 8) and 10), it becomes easier for the refrigerant to flow from the fourth compartment into the fifth compartment through the lower refrigerant passage section, and the passage resistance of the lower refrigerant passage section decreases. As a result, the cooling performance of the evaporator becomes excellent.

According to the evaporator of par. 11), even when the refrigerant having flowed from the first ascending flow tube group into the second compartment receives the influence of gravitational force, the amount of the refrigerant flowing into the heat exchange tubes of the first descending flow tube group is decreased, and the flow of the refrigerant which passes through the first refrigerant passage section and enters the heat exchange tubes of the second descending flow tube group through the third compartment is promoted. Accordingly, the amounts of the refrigerant flowing in all the heat exchange tubes of the first and second descending flow tube groups can be equalized, so that the cooling performance of the evaporator becomes excellent.

What is claimed is:

1. An evaporator comprising:

a first upper header;

a first lower header disposed below the first upper header to be parallel to the first upper header;

a plurality of first heat exchange tubes which are disposed between the first upper header and the first lower header and whose upper and lower end portions are connected to the first upper header and the first lower header, respectively;

a first descending flow tube group which is composed of a plurality of the first heat exchange tubes and in which refrigerant flows from an upper side toward a lower side thereof;

a first ascending flow tube group which is composed of a plurality of the first heat exchange tubes, in which the refrigerant flows from a lower side toward an upper side thereof, and which is provided adjacent to the first descending flow tube group;

a first compartment which is provided in the first upper header and with which an upper end portion of the first descending flow tube group communicates;

a second compartment which is provided in the first upper header to be located adjacent to the first compartment, with which an upper end portion of the first ascending flow tube group communicates, and from which the refrigerant flows out toward the first compartment;

a second upper header disposed to be parallel to the first upper header;

a second lower header disposed below the second upper header to be parallel to the second upper header and the first lower header;

a plurality of second heat exchange tubes which are disposed between the second upper header and the second lower header and whose upper and lower end portions are connected to the second upper header and the second lower header, respectively;

a second descending flow tube group which is composed of a plurality of the second heat exchange tubes, in which the refrigerant flows from an upper side toward a lower side thereof, and which is provided next to the first descending flow tube group in an air-passage direction;

a third compartment which is provided in the second upper header and with which an upper end portion of the second descending flow tube group communicates; and a first flow distribution control section which is provided between the first compartment and the third compartment and which has a first refrigerant passage section for establishing communication between the first compartment and the third compartment, wherein a first portion of the first refrigerant passage section located on a side toward the second compartment has an area greater than that of a second portion of the first refrigerant passage section located on a side opposite the second compartment, wherein first tube ends of the first heat exchange tubes of the first descending flow tube group project into the first compartment to an extent that the first tube ends at least partially overlap the first refrigerant passage section when viewed in a direction orthogonal to a plane containing the first upper header and the first lower header, and wherein second tube ends of the second heat exchange tubes of the second descending flow tube group project into the third compartment to an extent that the second tube ends at least partially overlap the first refrigerant passage section when viewed in a direction orthogonal to a plane containing the second upper header and the second lower header.

2. The evaporator according to claim 1, wherein the first refrigerant passage section is composed of a plurality of first refrigerant passages formed in the first flow distribution control section such that the first refrigerant passages are spaced from one another in a longitudinal direction of the two upper headers;

a plurality of passage sets each composed of a plurality of the first refrigerant passages having the same passage area are arranged in the longitudinal direction of the two upper headers; and in the passage sets located adjacent to each other in the longitudinal direction of the two upper headers, the passage area of the first refrigerant passages of the passage set on the side toward the second compartment is greater than the passage area of the first refrigerant passages of the passage set on the side opposite the second compartment.

3. The evaporator according to claim 2, wherein lower ends of all the first refrigerant passages of the first refrigerant passage section are located at the same vertical position; and the lower ends of all the first refrigerant passages are located at a vertical position below upper ends of all the first heat exchange tubes of the first descending flow tube group and upper ends of all the second heat exchange tubes of the second descending flow tube group.

4. The evaporator according to claim 1, wherein the first refrigerant passage section is composed of a plurality of first refrigerant passages formed in the first flow distribution control section such that the first refrigerant passages are spaced from one another in a longitudinal direction of the two upper headers; and all the first refrigerant passages have different passage areas gradually increasing from the side opposite the second compartment toward the second compartment side.

5. The evaporator according to claim 4, wherein lower ends of all the first refrigerant passages of the first refrigerant passage section are located at the same vertical position; and the lower ends of all the first refrigerant passages are located at a vertical position below upper ends of all the first heat exchange tubes of the first descending flow tube group and upper ends of all the second heat exchange tubes of the second descending flow tube group.

6. The evaporator according to claim 1, further comprising:

a fourth compartment which is provided in the first lower header and with which a lower end portion of the first descending flow tube group communicates;

a second ascending flow tube group which is composed of a plurality of the second heat exchange tubes, in which the refrigerant flows from a lower side toward an upper side thereof, and which is provided adjacent to the second descending flow tube group;

a fifth compartment which is provided in the second lower header and with which a lower end portion of the second descending flow tube group communicates;

a sixth compartment which is provided in the second lower header to be located adjacent to the fifth compartment, with which a lower end portion of the second ascending flow tube group communicates, and into which the refrigerant flows from the fifth compartment; and a second flow distribution control section which is provided between the fourth compartment and the fifth compartment and which has a second refrigerant passage section for establishing communication between the fourth compartment and the fifth compartment, wherein a first portion of the second refrigerant passage section located on a side toward the sixth compartment has an area smaller than that of a second portion of the second refrigerant passage section located on a side opposite the sixth compartment.

7. The evaporator according to claim 6, wherein the second refrigerant passage section has an upper end which is located at a vertical position above lower ends of all the first heat exchange tubes of the first descending flow tube group and lower ends of all the second heat exchange tubes of the second descending flow tube group.

8. The evaporator according to claim 6, wherein the second refrigerant passage section is composed of a plurality of second refrigerant passages formed in the second flow distribution control section such that the second refrigerant passages are spaced from one another in a longitudinal direction of the two lower headers; and all the second refrigerant passages have different passage areas gradually decreasing from the side opposite the sixth compartment toward the sixth compartment side.

9. The evaporator according to claim 8, wherein upper ends of all the second refrigerant passages of the second refrigerant passage section are located at the same vertical position; and the upper ends of all the second refrigerant passages are located at a vertical position above lower ends of all the first heat exchange tubes of the first descending flow tube group and lower ends of all the second heat exchange tubes of the second descending flow tube group.

10. The evaporator according to claim 1, wherein the total area of the first refrigerant passage section is greater than the total passage sectional area of the refrigerant passages of all the first heat exchange tubes of the first descending flow tube group.

11. The evaporator according to claim 1, wherein a refrigerant inlet is provided at one end of the first upper header, and a refrigerant outlet is provided at one end of the second upper header, which end is located on the same side as the refrigerant inlet; and the first descending flow tube group and the second descending flow tube group are provided on a side opposite the refrigerant inlet and the refrigerant outlet.

12. An evaporator comprising:

a first upper header;

a first lower header disposed below the first upper header to be parallel to the first upper header;

a plurality of first heat exchange tubes which are disposed between the first upper header and the first lower header and whose upper and lower end portions are connected to the first upper header and the first lower header, respectively;

a first descending flow tube group which is composed of a plurality of the first heat exchange tubes and in which refrigerant flows from an upper side toward a lower side thereof;

a first ascending flow tube group which is composed of a plurality of the first heat exchange tubes, in which the refrigerant flows from a lower side toward an upper side thereof, and which is provided adjacent to the first descending flow tube group;

a first compartment which is provided in the first upper header and with which an upper end portion of the first descending flow tube group communicates;

a second compartment which is provided in the first upper header to be located adjacent to the first compartment, with which an upper end portion of the first ascending flow tube group communicates, and from which the refrigerant flows out toward the first compartment;

a second upper header disposed to be parallel to the first upper header;

a second lower header disposed below the second upper header to be parallel to the second upper header and the first lower header;

a plurality of second heat exchange tubes which are disposed between the second upper header and the second lower header and whose upper and lower end portions are connected to the second upper header and the second lower header, respectively;

a second descending flow tube group which is composed of a plurality of the second heat exchange tubes, in which the refrigerant flows from an upper side toward a lower side thereof, and which is provided next to the first descending flow tube group in an air-passage direction;

a third compartment which is provided in the second upper header and with which an upper end portion of the second descending flow tube group communicates; and a first flow distribution control section which is provided between the first compartment and the third compartment and which has a first refrigerant passage section for establishing communication between the first compartment and the third compartment, wherein a first portion of the first refrigerant passage section located on a side toward the second compartment has an area greater than that of a second portion of the first refrigerant passage section located on a side opposite the second compartment, wherein the first refrigerant passage section is composed of a plurality of first refrigerant passages formed in the first flow distribution control section such that the first refrigerant passages are spaced from one another in a longitudinal direction of the two upper headers, wherein a plurality of passage sets each composed of a plurality of the first refrigerant passages having the same passage area are arranged in the longitudinal direction of the two upper headers, wherein, in the passage sets located adjacent to each other in the longitudinal direction of the two upper headers, the passage area of the first refrigerant passages of the passage set on the side toward the second compartment is greater than the passage area of the first refrigerant passages of the passage set on the side opposite the second compartment, wherein lower ends of all the first refrigerant passages of the first refrigerant passage section are located at the same vertical position, and wherein the lower ends of all the first refrigerant passages are located at a vertical position below upper ends of all the first heat exchange tubes of the first descending flow tube group and upper ends of all the second heat exchange tubes of the second descending flow tube group.

13. The evaporator according to claim 1, wherein the first compartment and the third compartment are so contracted such that the refrigerant flows from the first compartment to the third compartment via the first refrigerant passage section in a refrigerant flowing direction opposite to an air-passage direction.

* * * * *